US007044415B2

(12) United States Patent
Wiesemann et al.

(10) Patent No.: US 7,044,415 B2
(45) Date of Patent: May 16, 2006

(54) FISH TAPE WINDER INSERT

(75) Inventors: David L. Wiesemann, Pewaukee, WI (US); David A. Huebschen, Menomonee Falls, WI (US); Debra L. Weich, Mequon, WI (US)

(73) Assignee: Actuant Corporation, Glendale, WI (US)

( * ) Notice: Subject to any disclaimer, the term of this patent is extended or adjusted under 35 U.S.C. 154(b) by 64 days.

(21) Appl. No.: 10/777,816

(22) Filed: Feb. 12, 2004

(65) Prior Publication Data

US 2005/0029383 A1 Feb. 10, 2005

Related U.S. Application Data

(60) Provisional application No. 60/493,678, filed on Aug. 8, 2003.

(51) Int. Cl.
*B65H 75/40* (2006.01)

(52) U.S. Cl. ..... 242/405.3; 242/588.2; 254/134.3 FT

(58) Field of Classification Search ..... 242/405.3, 242/588.2, 256, 389; 254/134.3 FT, 352
See application file for complete search history.

(56) References Cited

U.S. PATENT DOCUMENTS

| | | | | |
|---|---|---|---|---|
| 1,592,030 | A | | 7/1926 | Langsner |
| 2,743,884 | A | | 5/1956 | Briggs |
| 3,528,644 | A | | 9/1970 | Scott |
| 4,056,859 | A | | 11/1977 | Pace |
| 4,092,780 | A | | 6/1978 | Trethewey et al. |
| 4,164,334 | A | | 8/1979 | Rathbun et al. |
| 4,215,828 | A | | 8/1980 | Rathbun et al. |
| 4,251,038 | A | | 2/1981 | Gename |
| 4,673,143 | A | * | 6/1987 | Intengan ..... 242/396.9 |
| 4,844,376 | A | | 7/1989 | Maraman, Sr. |
| 4,856,729 | A | | 8/1989 | Maraman |
| 4,917,362 | A | | 4/1990 | Wilson |
| D341,329 | S | | 11/1993 | Morris |
| D351,561 | S | | 10/1994 | Moffatt et al. |
| 5,377,626 | A | | 1/1995 | Kilsby et al. |
| 5,588,613 | A | | 12/1996 | Nagy |
| D408,749 | S | | 4/1999 | Walsten |
| 6,016,609 | A | | 1/2000 | Donovan et al. |
| 6,224,038 | B1 | | 5/2001 | Walsten et al. |

(Continued)

OTHER PUBLICATIONS

The Timken Company; torrington—drawn cup roller clutches/ assemblies; web page from www.timken.com; copyright 2003.

(Continued)

*Primary Examiner*—Kathy Matecki
*Assistant Examiner*—Sang Kim
(74) *Attorney, Agent, or Firm*—Quarles & Brady LLP

(57) ABSTRACT

A winder insert for a fish tape reel fits into a center opening of the fish tape reel and engages an inner periphery of the reel. The insert has an attachment member, which can be a multi-sided socket for example, that is engaged by a removable handle or lever member to rotate the insert and in turn the reel with respect to a reel handle grasped by the user so as to wind and/or unwind fish tape in the reel. In one preferred form, a roller clutch is pressed into a center opening of the insert about a drive shaft that is rotated by the handle. The handle and shaft can be rotated in one direction to engage the clutch and thereby rotate the reel. Rotating the winder handle in the opposite direction overruns the clutch so that the handle can ratchet back to the original position without unwinding the reel. The winder insert removably snaps onto the reel.

16 Claims, 8 Drawing Sheets

U.S. PATENT DOCUMENTS

| | | | | |
|---|---|---|---|---|
| 6,361,021 | B1 | 3/2002 | Brennan | |
| 6,416,040 | B1 | 7/2002 | Bergman | |
| 6,513,791 | B1 | 2/2003 | Yates | |
| 6,722,603 | B1 | 4/2004 | Atencio | |
| 2002/0008130 | A1 | 1/2002 | Fisher et al. | |
| 2005/0194488 | A1* | 9/2005 | Radle et al. | 242/395 |

OTHER PUBLICATIONS

Daman Tools, Inc.; Reel-Power Universal Fish Tape Insert; web page from http://damantools.com/inserts.html; printed May 8, 2003.

* cited by examiner

FISH TAPE WINDER INSERT

CROSS-REFERENCE TO RELATED APPLICATION

This application claims benefit to U.S. Provisional Application No. 60/493,678 filed Aug. 8, 2003.

STATEMENT OF FEDERALLY SPONSORED RESEARCH OR DEVELOPMENT

Not applicable.

BACKGROUND OF THE INVENTION

1. Technical Field

The present invention relates to fish tapes of the type used by electricians to pull wire through conduit or other spaces, and more particularly to a device for winding the fish tape onto a reel assembly.

2. Description of the Related Art

A fish tape is a stiff but bendable wire, flexible rod or flat tape typically used to install wire in conduit, through existing walls, or other tight spaces. Because typical electrical wire is very flexible, pushing it through long lengths of conduit is virtually impossible. Pulling wire along the desired path is much more effective. In order to pull the wire, a fish tape, being more rigid than electrical wire, is first pushed along the desired path. Once an end of the fish tape reaches the end of the desired path, the electrical wire is attached to the fish tape end, and the fish tape is retrieved which pulls the wire with it.

The fish tape is typically coiled inside of a reel assembly. For example U.S. Pat. No. 4,092,780 has a generally annular tape receiving chamber bounded at its periphery by a pair of opposed lips, which separate to permit winding and unwinding of the fish tape in the chamber. A handle having a tape passage is mounted between the lips, which provides passage of the tape out of and into the receiving chamber. This reel arrangement makes it somewhat difficult to wind and unwind the tape. Given the relative rigid and springy characteristics of the fish tape, coiling the fish tape can require significant force and can be time consuming and frustrating, particularly if the fish tape binds inside of the reel.

U.S. Pat. No. 6,361,021 discloses a fish tape device having a similar structure as in the above patent. To facilitate winding of the fish tape, this reel assembly is adapted to be driven by a power drill or driver. In particular, it has a large gear attached to the rotatable part of the reel assembly. Another small gear is rotatably mounted to a fixed part of the reel assembly by an axle extending to the exterior of the reel assembly that can be engaged by a socket of the power driver. Operating the driver thus turns the small gear which meshes with the larger gear for winding the fish tape within the reel assembly. While this greatly aids in the winding process it requires a power drill, which is large, expensive, needs external power and may not be readily available at the job site.

U.S. Pat. No. 6,224,038 discloses another solution to the winding difficulties associated with conventional fish tape reels discussed above. In this patent, the fish tape is contained in a cassette that loads easily into the main body of the reel. The cassette has its own handle for rotating the cassette relative to the reel body and thereby winding the tape. While this design provides significant benefits over conventional fish tape reels, the cassette feature adds expense and is generally designed for shorter length fish tape.

SUMMARY OF THE INVENTION

The present invention is a winder mechanism for winding and/or unwinding fish tape in a fish tape reel.

Specifically, the present invention provides a winder insert for a fish tape reel that is rotatable about a center axis relative to its handle to wind or unwind fish tape about an inner periphery of the reel. The insert engages the reel and has an attachment member that can be engaged by a lever member to rotate the winder insert about the center axis. Rotation of the winder insert in turn rotates the reel about the center axis so as to revolve the fish tape about the center axis.

When the lever member is linked to the attachment member, rotating the lever member in a first direction, for example a winding direction, rotates the winder insert in that direction and rotating the lever member the opposite direction, for example an unwinding direction, rotates the winder insert that opposite direction. Alternatively, the winder insert can include a ratchet or clutch mechanism so that when the winder insert turns when the lever member is rotated in the first direction and does not turn when the lever member is rotated in the opposite direction. Thus, for example, the winder insert could be used to wind the fish tape onto the reel by turning the lever clockwise and unwind the fish tape from the reel by turning the lever counter-clockwise, or the winder could be used just to wind or unwind the fish tape using a ratchet action.

Preferably, the lever member removably engages the attachment member in a stud and socket arrangement. The attachment member can be an axle or shaft rotatably disposed along the center axis within a center opening of the winder insert. The shaft can be disposed within a clutch having an outer surface fixed with respect to the winder insert.

In one preferred form, the clutch is a conventional drawn cup roller clutch having a plurality of rollers that contact the periphery of the shaft. The rollers are free to spin when the shaft is rotated in one direction, with very little torque required to overrun in the one direction, but bind against interior ramped surfaces in the clutch when the shaft is rotated in the opposite direction. And, preferably the shaft has a socket concentric with the center axis that receives a drive stud of the handle, which is secured to the shaft by a threaded fastener. The shaft can have sockets formed in both opposite ends such that the handle can be mounted to either side for alternate left hand or right hand operation.

In still other preferred forms, the sprocket section of the hub has a plurality of sprocket-like structures, preferably three spaced around the center axis at equal angles, sized to engage mating surfaces at the inner periphery of the reel. These sprockets define concave surfaces abutting convex surfaces at the inner periphery of the reel. The winder mechanism is preferably removably mounted to the reel with the reel disposed between the winder handle and the winder hub flange. Spring tabs on the winder can clip onto the reel assembly housing to hold the winder in place. Deflecting the spring tabs allows the winder insert to be removed from the reel quickly and easily.

These and still other advantages of the invention will be apparent from the detailed description and drawings. What follows are preferred embodiments of the present invention. To assess the full scope of the invention the claims should be looked to as the preferred embodiments are not intended as the only embodiments within the scope of the invention.

DETAILED DESCRIPTION OF THE PREFERRED EMBODIMENTS

Figure 1:
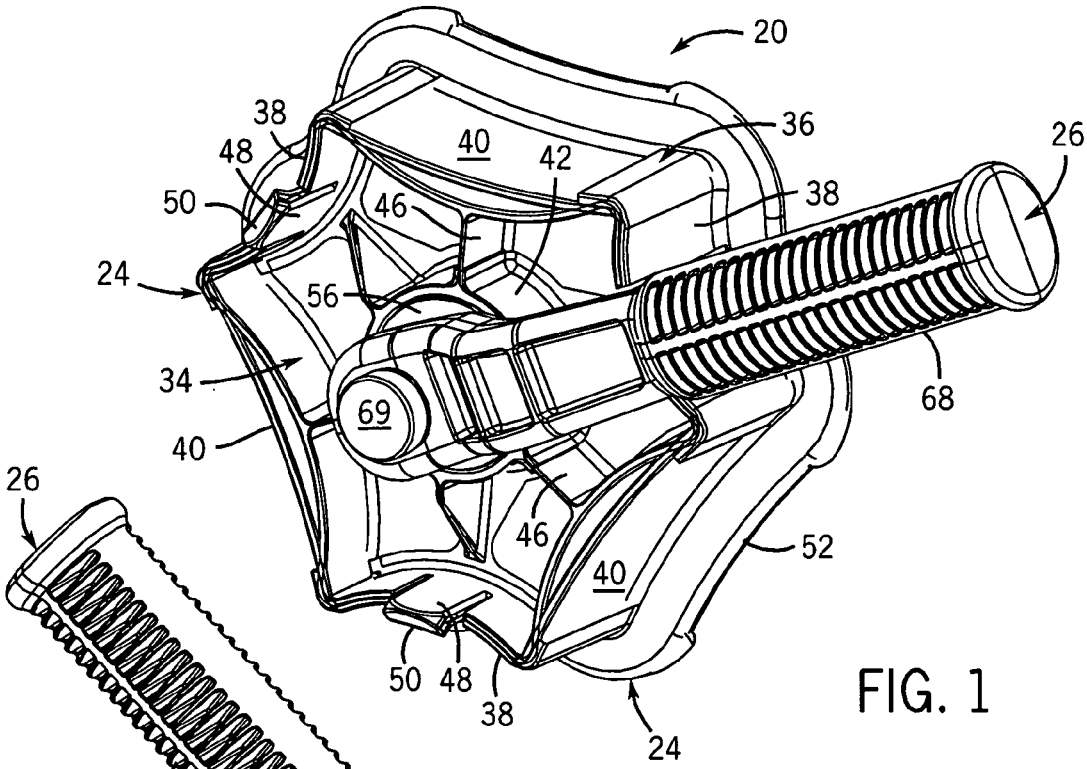
FIG. 1 is a front perspective view of a fish tape winder insert according to the present invention.
Figure 2:
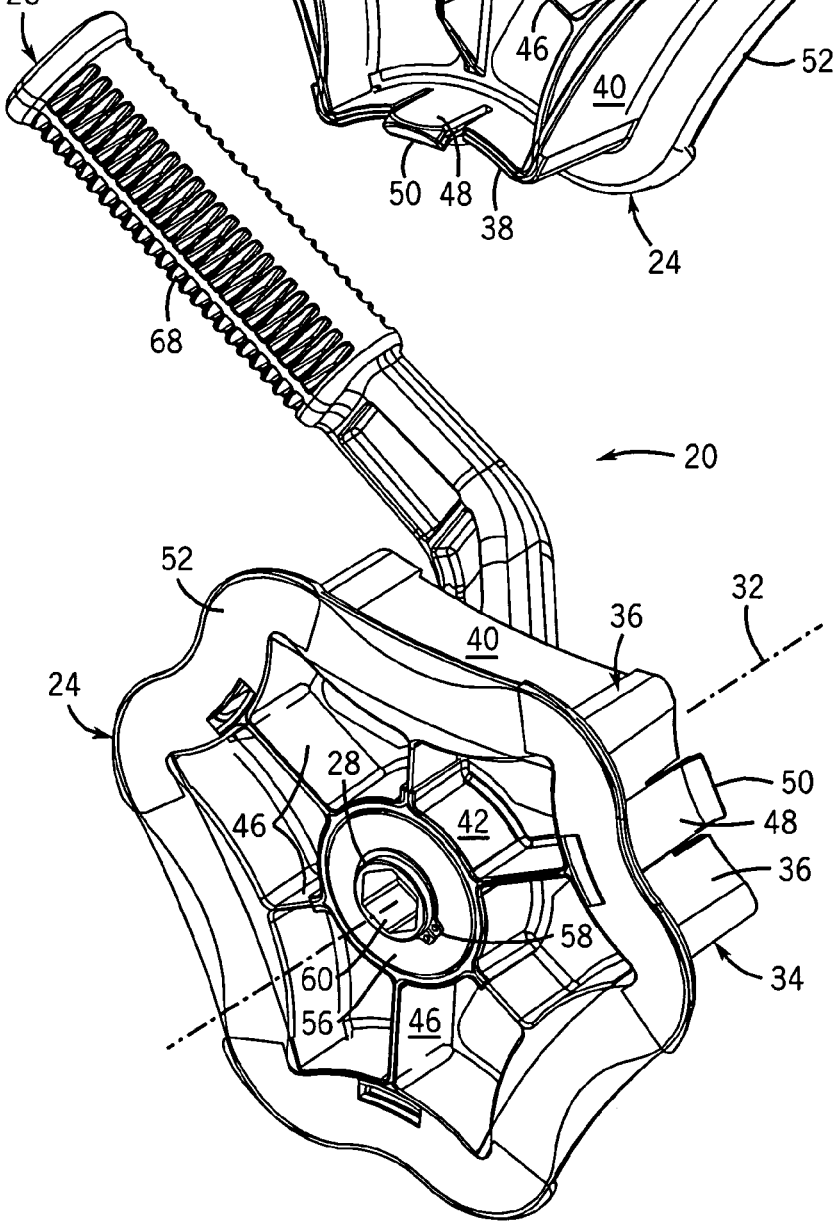
FIG. 2 is a rear perspective view thereof.

The drawings referenced herein illustrate a preferred version of a winder insert 20 for a fish tape reel assembly 22 (preferably as shown in FIGS. 9–12). Referring to FIGS. 1–6, the primary components of the winder insert 20 include a plastic hub 24, a plastic winder handle 26, a steel shaft 28 and a roller clutch 30. All of these components are assembled so as to be disposed along and/or concentric a center axis 32, shown in FIG. 2.

The hub 24 has main sprocket section 34 defined by a peripheral wall 36 configured to define three concave sprockets 38 interposed at equal 120 degree angles between three less concave and longer spanning sections 40. The radii, length and width of the sprockets 38 and spanning sections 40 are selected in order to fit within a central opening, and thereby engage an inner periphery 44, of the fish tape reel assembly 22, as will be discussed below. The peripheral wall 36 is braced by interior ribbing and spokes 46 that join a generally cylindrical inner hub 42. Formed into the middle of the sprocket sections 38 are three spring tabs 48 having radially extending catches 50 formed at their free ends which extend axially further than the rest of the peripheral wall 34 for engaging a surface of the fish tape reel assembly 22 at or near the inner periphery 44 thereof. At one side of the peripheral wall 36 (opposite the free ends of the spring tabs 48) is a peripheral flange 52 having generally the same contour as the peripheral wall 36 albeit of a having a larger overall dimension in the radial direction (perpendicular to the center axis 32). Again, the configuration and overall dimension of the flange 52 is dependent upon the inner periphery 44 of the fish tape reel assembly 22, although the flange 52 is sized larger than the inner periphery 44 so that it cannot pass completely through the center opening of the reel assembly 22.

Figure 3:
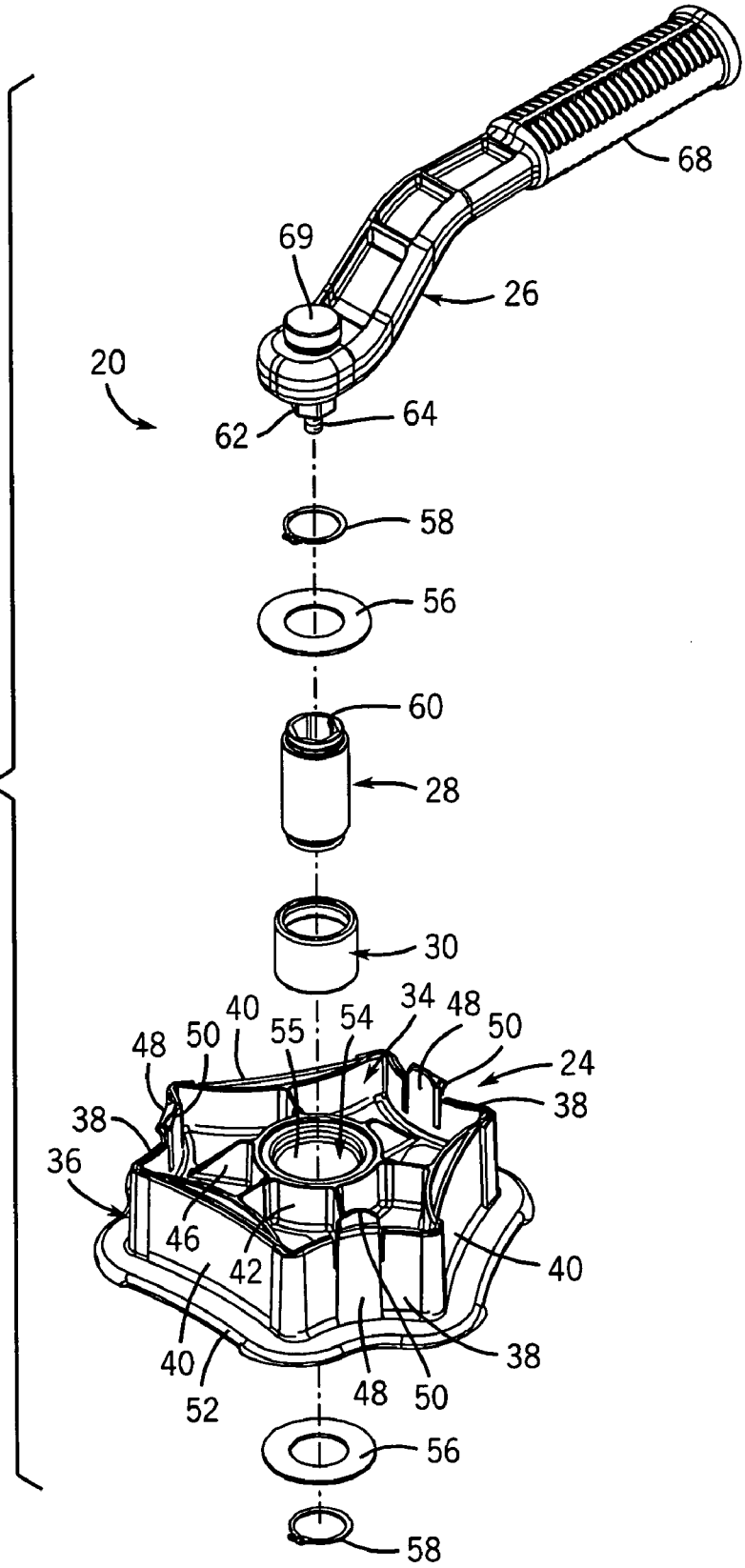
FIG. 3 is an exploded perspective view thereof.
Figure 4:
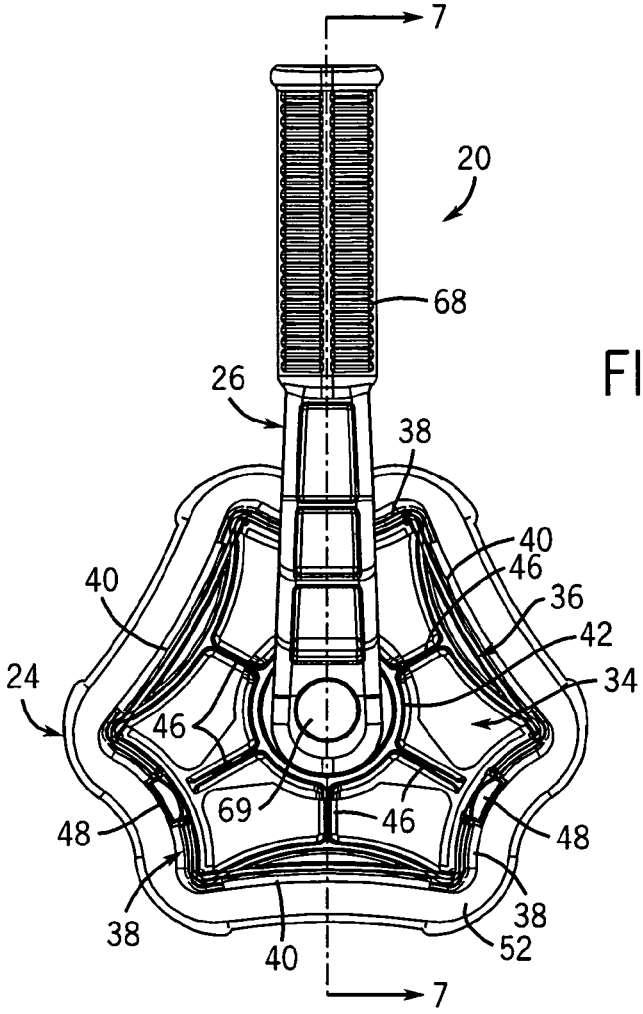
FIG. 4 is a side plan view thereof.
Figure 5:
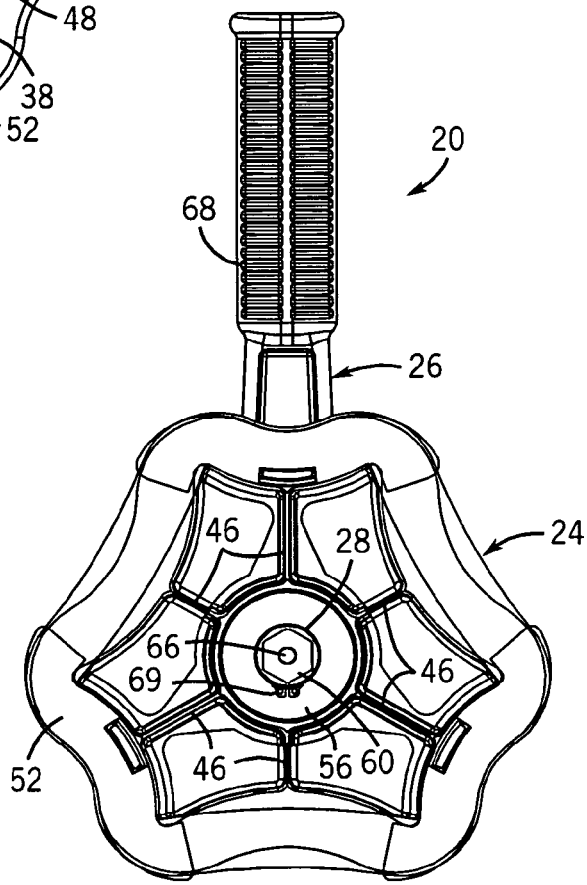
FIG. 5 is an opposite side plan view thereof.
Figure 6:
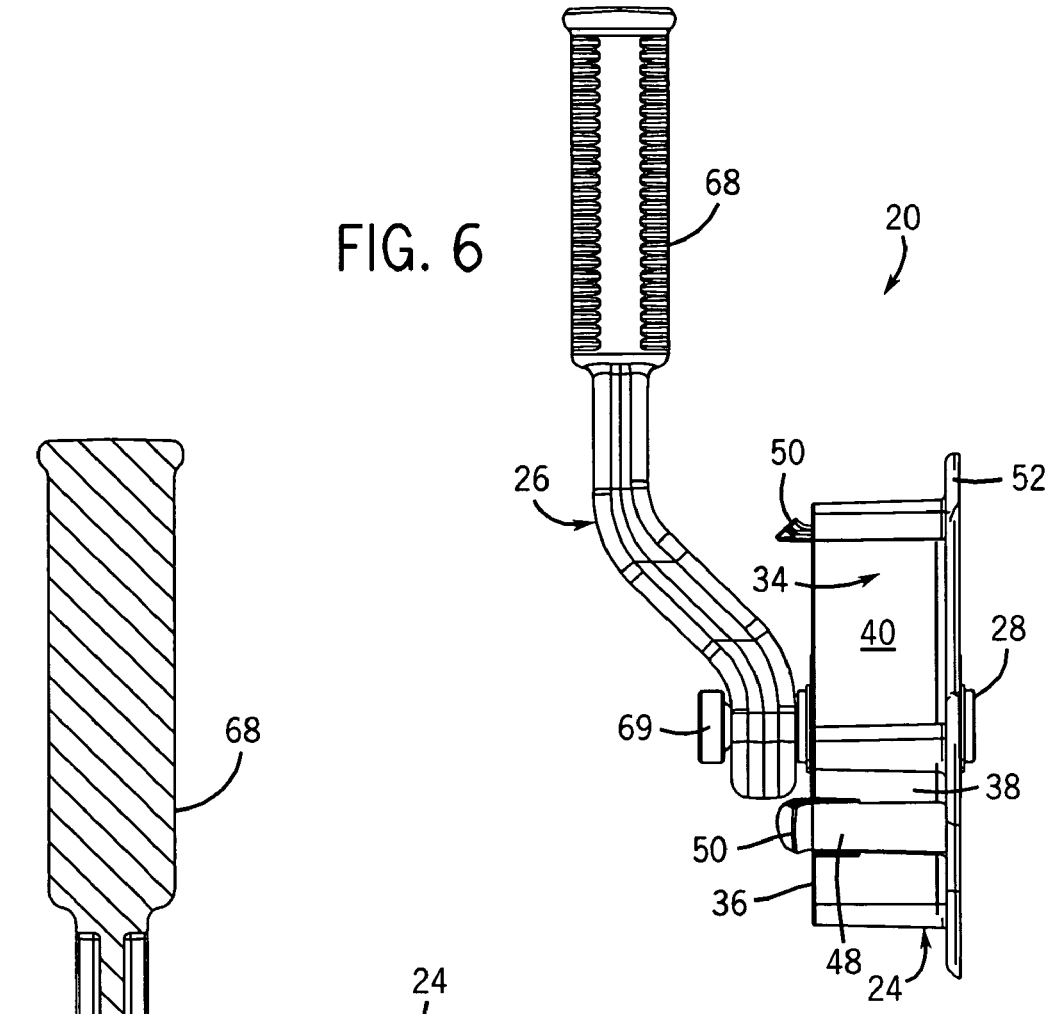
FIG. 6 is an end view thereof.
Figure 7:
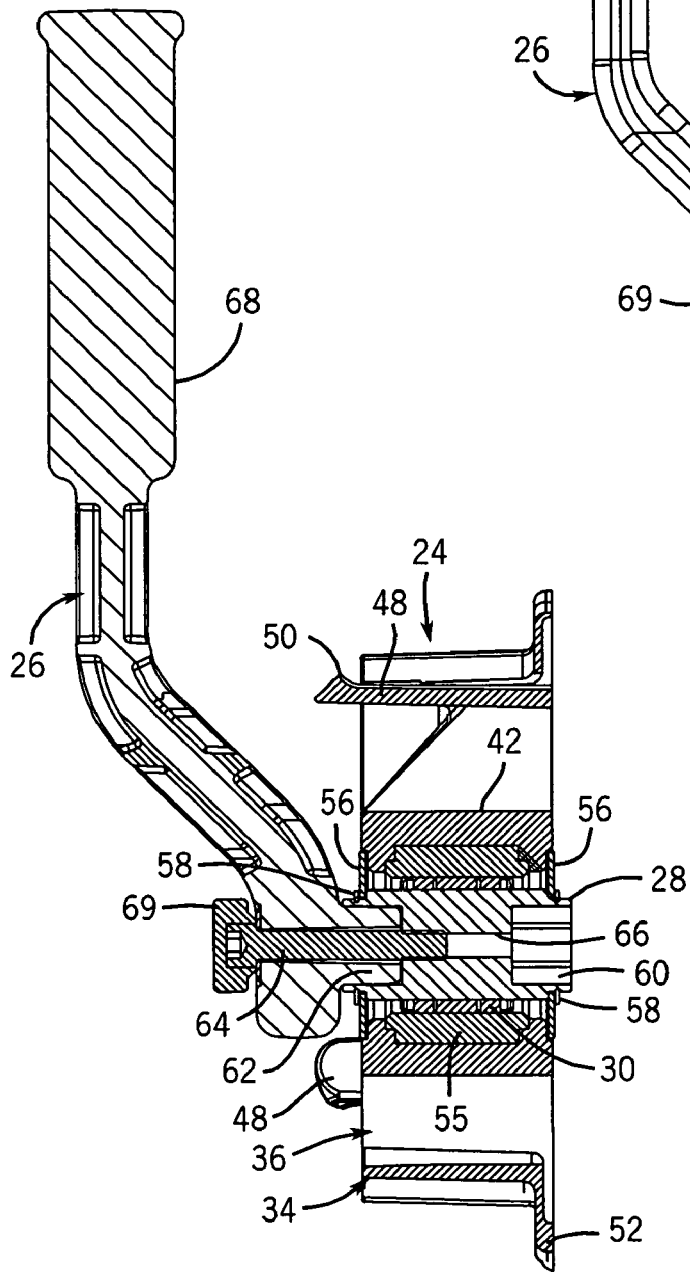
FIG. 7 is an end cross-sectional view taken along line 7—7 of FIG. 4.
Figure 8:
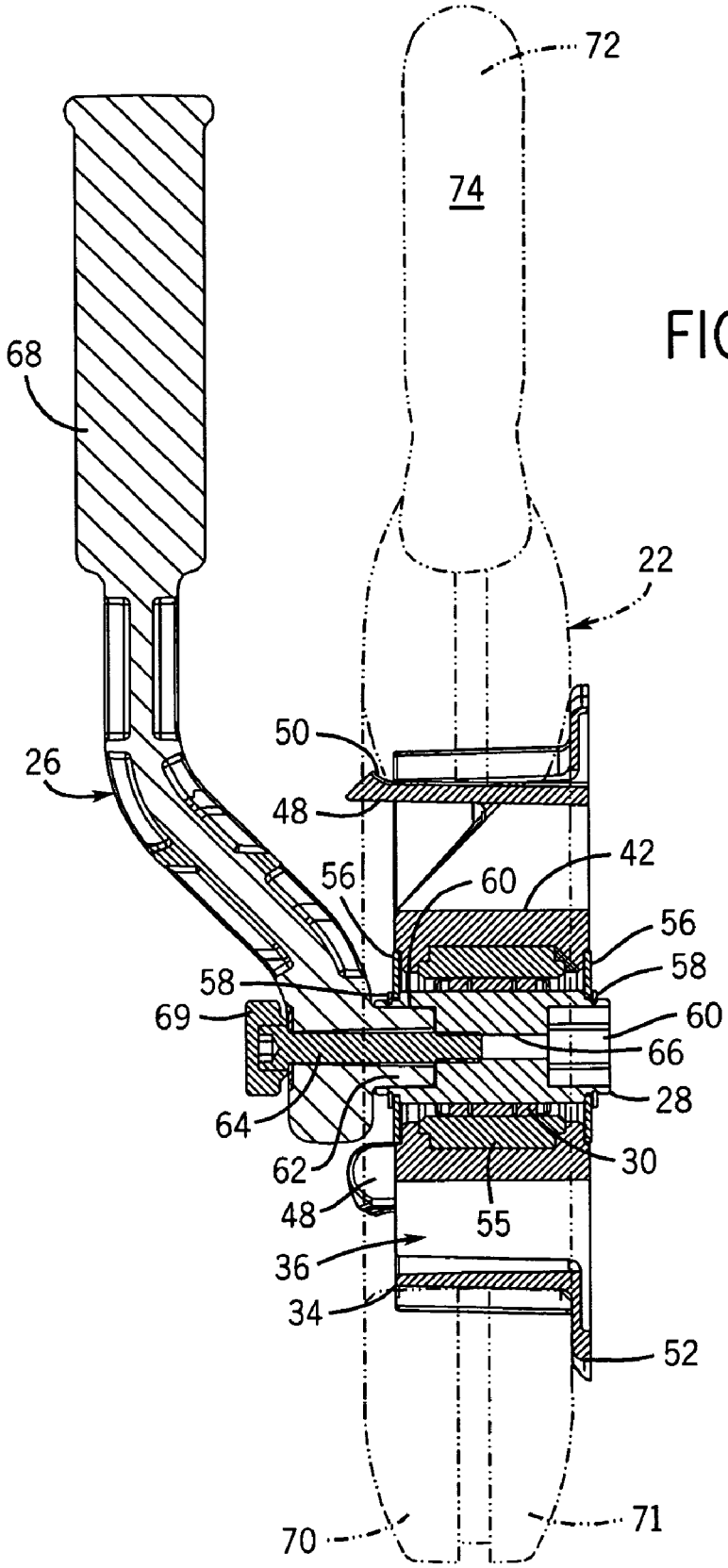
FIG. 8 is a sectional view similar to FIG. 7 with the winder insert mounted to a fish tape reel assembly shown in phantom.
Figure 10:
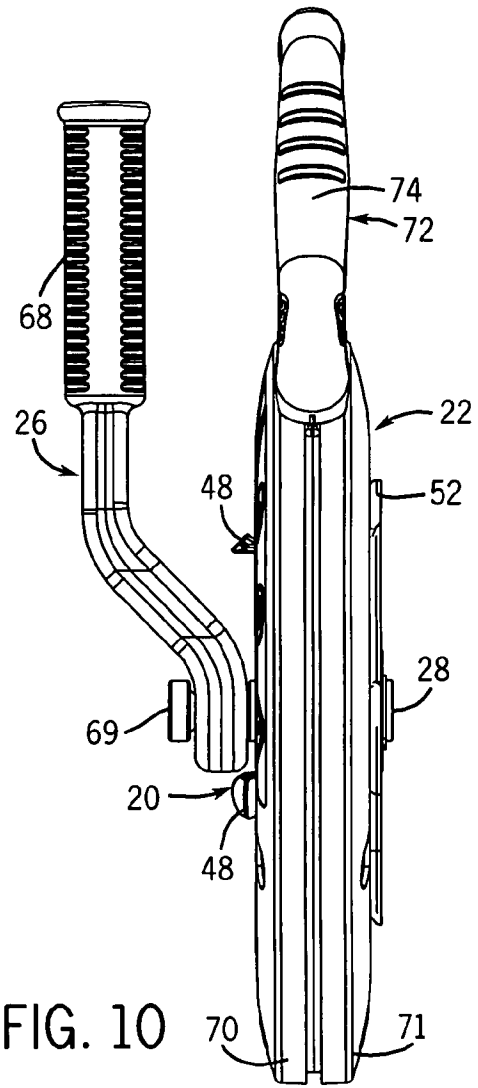
FIG. 10 is an end view thereof.

Referring to FIGS. 3, 7 and 8, the inner hub 42 defines a cylindrical opening 54 concentric with the center axis 32 in which is insert molded a steel hub bearing 55. Secured to the hub bearing 55, by press-fit or any other suitable engagement method, within the center opening 54 is the roller clutch 30. The roller clutch 30 is preferably a Torrington drawn cup roller clutch assembly, commercially available from The Timken Company of Canton, Ohio, as part number FCB-30. Generally, the roller clutch 30 has a cylindrical cup or ring containing several cylindrical steel rollers that are free to rotate when turned in one direction and which wedge against ramped interior surfaces when biased in the opposite direction so that they are prevented from rotating. The rollers bear against an outer diameter of the shaft 28 so that when the shaft 28 is rotated in one direction about the center axis 32 the rollers will spin freely and when the shaft 28 is rotated in the opposite direction the rollers will bind and cause the hub 24 to rotate about the center axis 32 along with the shaft 28. The shaft is retained in the center opening 54 within the roller clutch 30 by a pair of washers 56 secured to each end of the shaft 28 by two snap rings 58 clipped into grooves in the shaft 28. The shaft 28 defines two identical hexagonal sockets 60, one at each end. Each socket 60 is sized to receive a hex stud 62 formed at one end of the winder handle 26, which is secured to the shaft 28 by a threaded fastener 64 threaded into a threaded bore 66 of the shaft 28, the head of which is preferably concealed by a snap-on plastic cap 69.

The winder handle 26 angles back from the hex stud 62 and then straightens to form a hand grip 68 which is spaced from and generally parallel to the fish tape reel assembly 22 when the winder insert 20 is mounted thereto. The hand grip 68 has a plurality of rib features to reduce the amount of material required to make the winder handle 26 without sacrificing its structural integrity.

FIGS. 9–12 illustrate the winder insert 20 mounted to a preferred fish tape reel assembly 22. The preferred reel assembly 22 is described in detail in a co-pending application entitled "Ergonomic Fish Tape Reel" co-owned by the assignee of the present invention and hereby incorporated by reference as though fully set forth herein. Generally, however, the reel assembly 22 includes four components, namely, two annular housing halves 70 and 71 which are bolted together so as to slidably capture therebetween an interior portion of a split ring or shoe (not shown) of a reel handle 72. The reel handle 72 defines a forward leaning ergonomic pistol grip 74 that is located at an aft side of a vertical center line 75 (see FIG. 11) passing through the reel assembly 22 at the center of a hook feature 76. The housing halves 70 and 71 and the reel handle 72 define a passageway and exit aperture 78 through which passes in a generally horizontal direction (perpendicular to the vertical center line 75) an end 80 of a fish tape 82 wound inside of an annular cavity formed between the housing halves 70 and 71 where the other end (not shown) of the fish tape 82 is anchored. The fish tape 82 is preferably an elongated flat flexible metal tape. The reel handle 72 extends generally along a chord of the reel and is oriented to be grasped by one hand of a user in a generally straight horizontal wrist position while the winder handle 26 is grasped by the other hand of the user.

Figure 9:
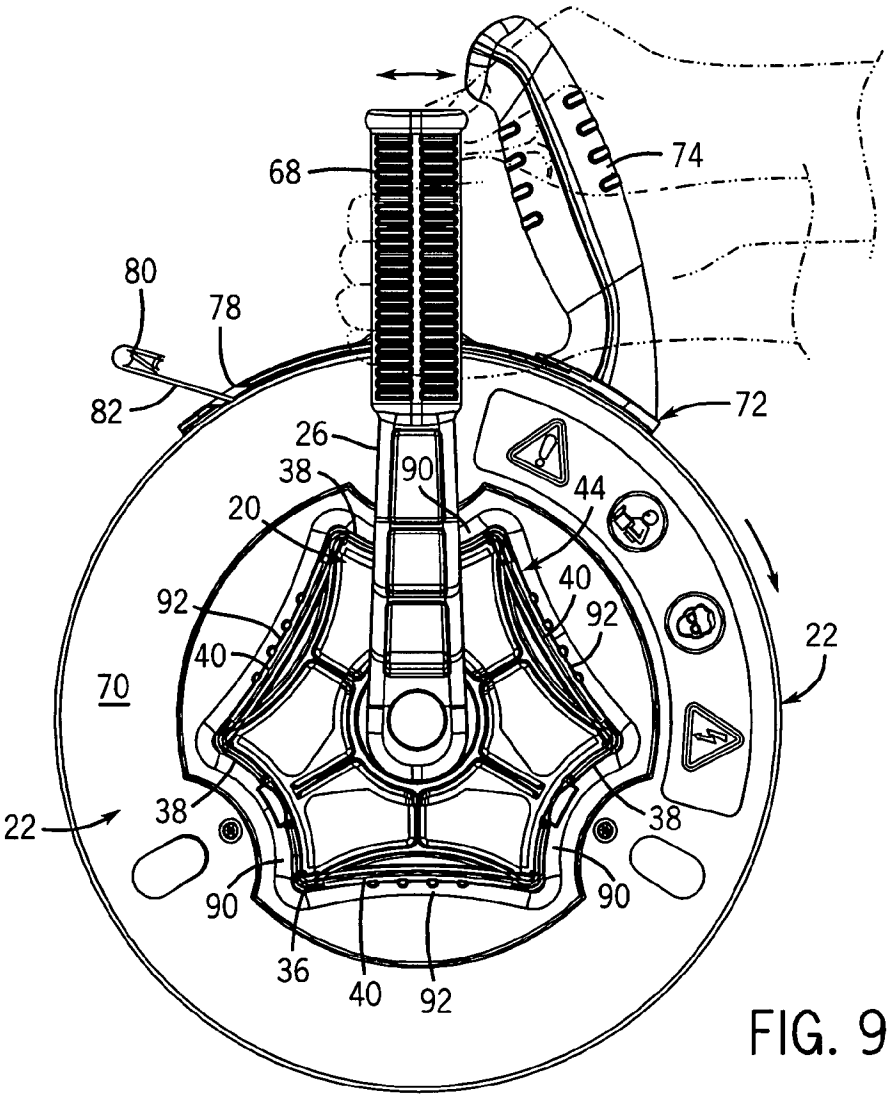
FIG. 9 is a side plan view of the fish tape reel assembly and winder insert.
Figure 12:
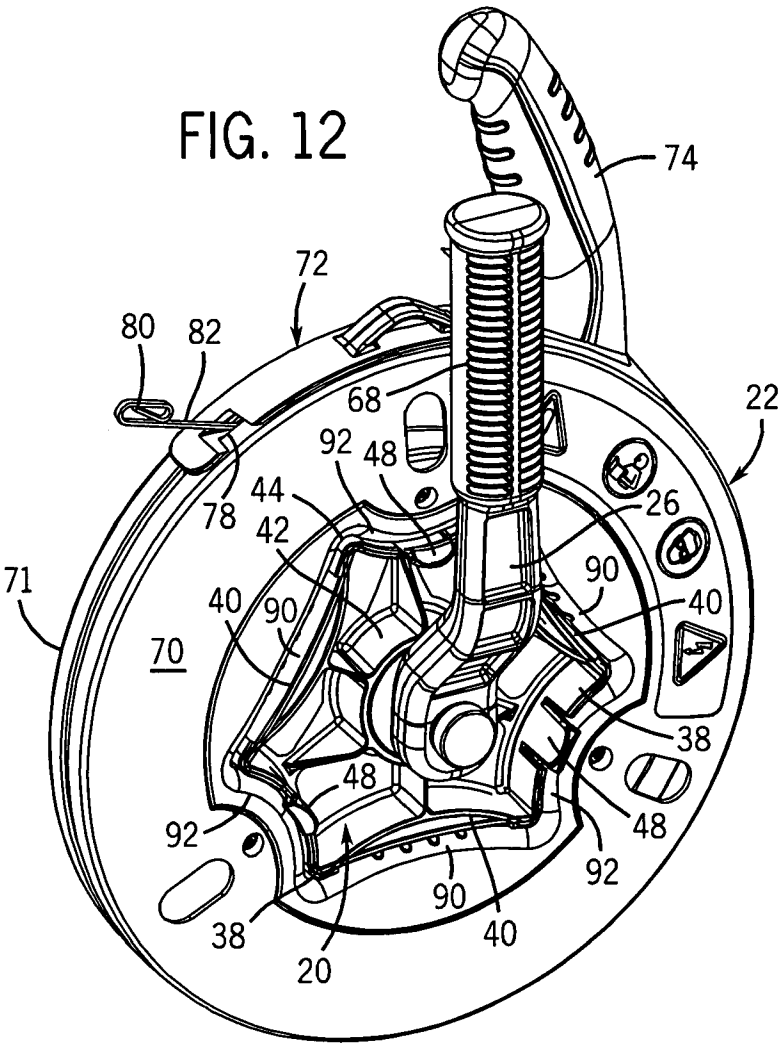
FIG. 12 is a front perspective view thereof.
Figure 11:
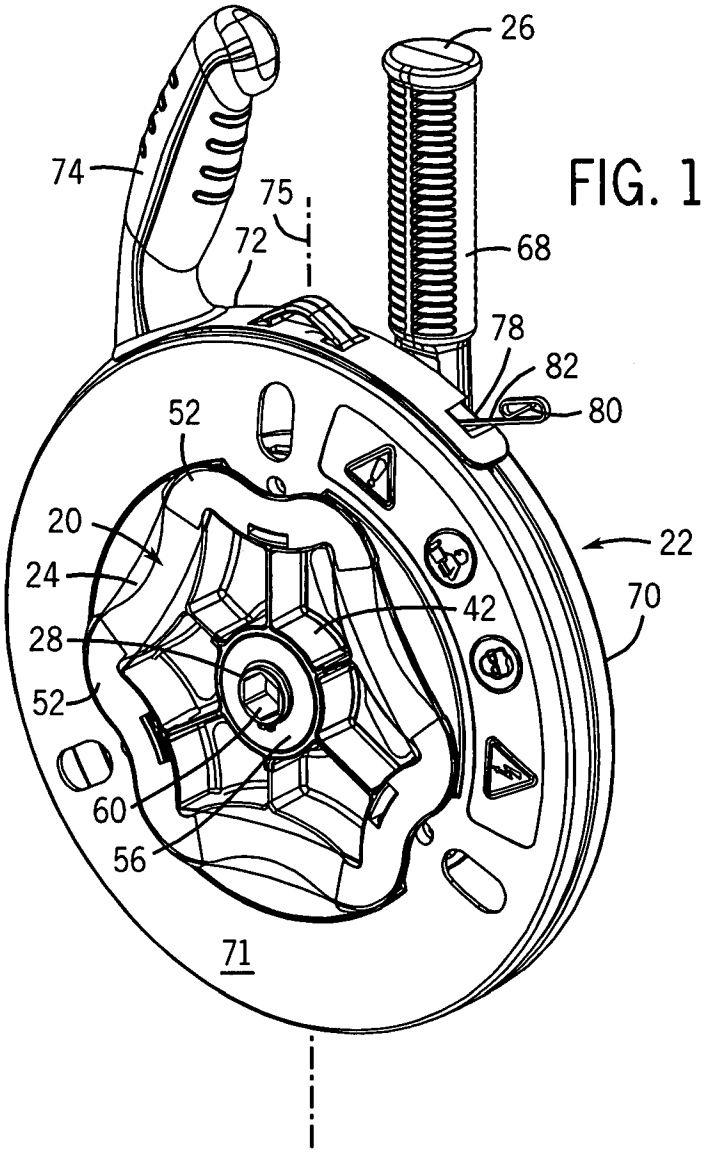
FIG. 11 is a rear perspective view thereof.

As shown, the winder insert 20 fits into the center opening 42 of the reel assembly 22 from one side so that the hub 24 is disposed inside the inner periphery 44 of the reel assembly 22 such that the concave sprocket sections 38 cup convex stops 90 and the spanning sections 40 cup interior grips 92. The peripheral flange 52 will abut the side of housing half 71 and the spring tabs 48 will "snap" over and clip onto an edge of the inner periphery 42 at the opposite housing half 70 to retain the winder insert 20 to the reel assembly 22. It can be removed simply by deflecting the spring tabs 48 inwardly and separating the components. Since the shaft 28 has two sockets 60, the winder handle 26 can be mounted to the hub 24 as shown in the drawings in which case the winder insert 20 must be tipped so that the winder handle 26 can pass through the center opening 42 before the hub 24 is inserted. In this arrangement, a user grasps the grip of the winder handle 26 with his or her left hand and grasps the pistol grip 74 of the reel handle 72 with his or her right hand, which is ergonomically designed to allow for a straight wrist and horizontal forearm position, as shown in FIG. 9. Or, the winder handle 26 can be mounted on the opposite side of the hub 24 simply by removing the cap 69 and threaded fastener 64, moving the winder handle 26 to the opposite side of the reel assembly 22 and reattaching the fastener 64 and the cap 69. In this case, the user would grasp the grip of the winder handle 26 with his or her right hand and the grip of the reel handle 72 with his or her left hand (again with a straight wrist and forearm). The roller clutch 30 remains in the same orientation regardless of the winder handle 26 position.

The fish tape reel and winder assembly is preferably used by manually pulling the free end 80 of the fish tape 82 away from the reel assembly 22 to unwind the desired length of fish tape 82, and the free end 80 of the fish tape 82 is guided along the desired path by the user. To retrieve the wire and/or store the fish tape 82, the fish tape 82 is wound back within the reel assembly 22 by grasping the reel handle 72 and holding the reel assembly 22 generally stationary with the wrist held straight and the forearm parallel to the ground. Then, the user pulls back on the winder handle 26 with the other hand, which is originally generally vertical in a neutral position of operation, moving it in a circular path toward the user's body at the top of the stroke, counterclockwise in the drawings, so as to rotate the housing parts 70 and 71 in this direction. Since the fish tape 82 is anchored to the housing this action winds the fish tape 82 inside of the reel assembly 22. The winder handle 26 can be spun in one or more complete revolutions to wind the fish tape 82, however, preferably it is pivoted about 120 degrees and then ratcheted back in the opposite rotational direction, which as discussed above disengage the shaft 28 from the roller clutch 30 and does not rotate the reel assembly housing with respect to the reel handle 74.

It should be noted that the roller clutch of the winder insert could be replaced with a bidirectional clutch or ratchet mechanism in which the ratchet direction can be changed, preferably by changing the position of a switch or lever on the mechanism. In this case, the winder insert could be operated to engage and rotate the reel assembly housing in both rotational directions so that the winder insert could also be used to unwind the fish tape.

Figure 13:
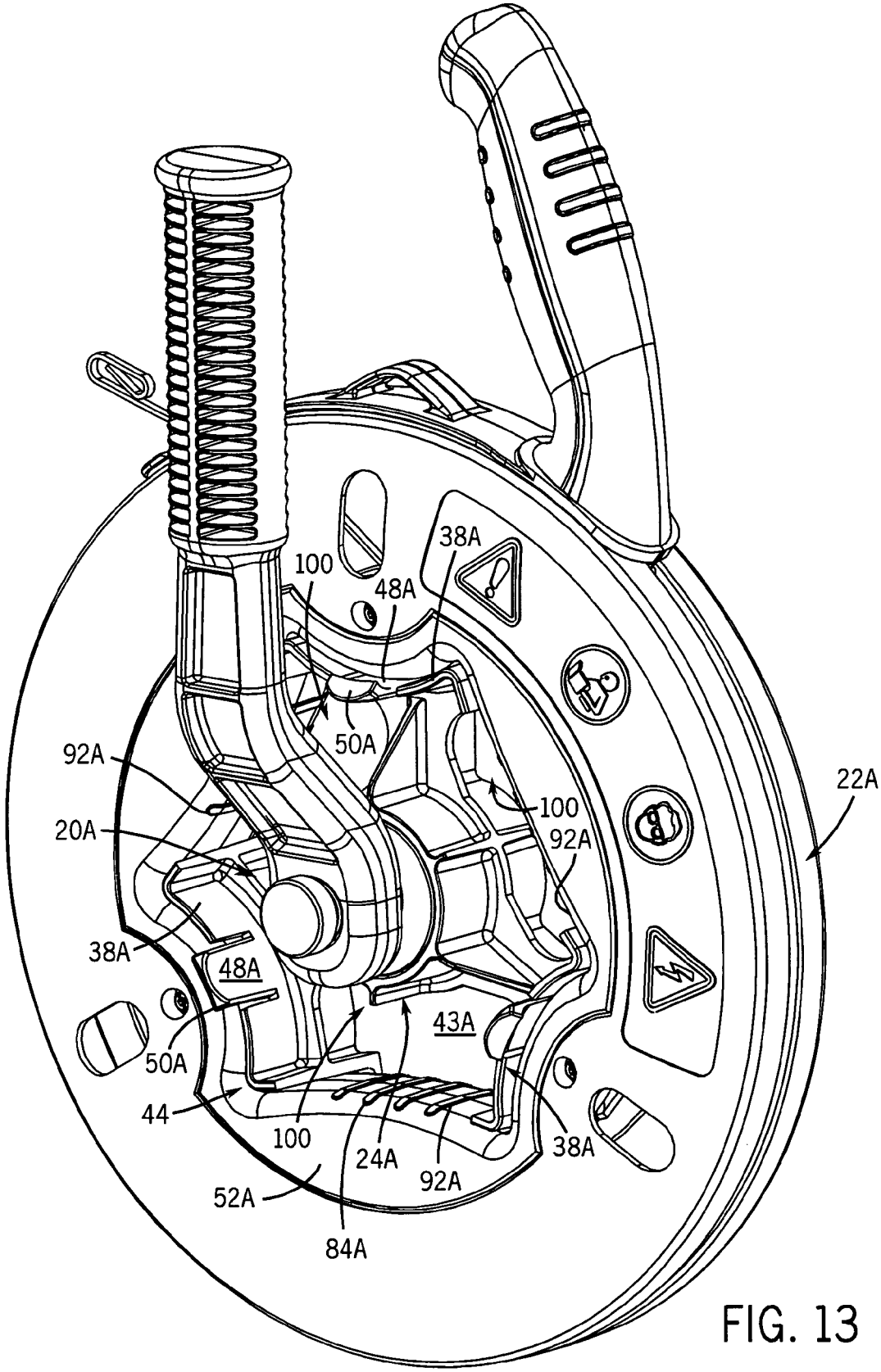
FIG. 13 is a rear perspective view of the fish tape reel assembly and another embodiment of the winder insert in which its hub defines openings that allow the user to manually grasp grips at the inner periphery of the reel assembly.

FIG. 13 shows an alternate embodiment of the winder insert 20A that includes the same components as described above except that the hub 24A has a different configuration designed to provide openings 100 allowing the user to grasp interior grips 92A of the reel assembly 22A without removing the winder insert 20A. In particular, here the winder hub 24A is not defined by a continuous peripheral wall, but rather by three angularly spaced concave sprockets 38A without any spanning sections joining them (as above). Like before, here the radii, length and width of the sprockets 38A are selected in order to fit within the central opening 43A and engage the inner periphery 44A of the fish tape reel assembly 22A. The sprockets 38A are joined by spokes 46A to a circular inner hub 48A housing the roller clutch and the shaft. Like above, the middle of the sprockets 38A are formed with spring tabs 48A having catches 50A formed at their free ends which extend axially further than the rest of the sprockets 38A for engaging a surface of the fish tape reel assembly 22*a* at or near the inner periphery 44 thereof. At the opposite side of each sprocket 38A is a flange 52A for engaging the side of the reel assembly 22A in much the same way as the peripheral flange described above.

This winder insert 20A operates in the same manner as described above, however, it gives the user the option of using either the winder insert 20A or the interior grips 92A to wind the fish tape without having to first remove the winder insert 20A from the reel assembly 22A.

It should be appreciated that merely preferred embodiments of the invention have been described above. However, many modifications and variations to the preferred embodiments will be apparent to those skilled in the art, which will be within the spirit and scope of the invention. Therefore, the invention should not be limited to the described embodiments. To ascertain the full scope of the invention, the following claims should be referenced.

What is claimed is:

1. A winder insert for a fish tape reel that is rotatable about a center axis to wind or unwind fish tape about an inner periphery of the reel, wherein the winder insert engages the reel and has an attachment member engageable by a lever member to rotate the winder insert about the center axis, wherein rotation of the winder insert by the lever member rotates the reel about the center axis so as to wind or unwind the fish tape about the center axis, wherein the attachment member is a shaft rotatably disposed along the center axis within a center opening of the winder insert, and wherein the shaft is disposed within a clutch having an outer surface fixed with respect to the winder insert, wherein rotating the lever member in a first direction rotates the shaft and in turn the clutch, and wherein rotating the lever member in a second direction rotates the shaft essentially without rotating the clutch in either of the first and second directions.

2. The winder insert of claim 1, wherein rotating the lever member in the first direction winds the fish tape about the inner periphery of the reel.

3. The winder insert of claim 1, wherein the clutch is a roller clutch mechanism.

4. The winder insert of claim 1, wherein the lever member engages the attachment member in socket.

5. The winder insert of claim 4, wherein the attachment member defines a multi-sided socket symmetric about the center axis.

6. The winder insert of claim 5, wherein the attachment member defines multi-sided sockets at opposite faces of the reel.

7. A winder insert for a fish tape reel that is rotatable about a center axis to wind or unwind fish tape about an inner periphery of the reel, wherein the winder insert engages the reel and has an attachment member engageable by a lever member to rotate the winder insert about the center axis, wherein rotation of the winder insert by the lever member rotates the reel about the center axis so as to wind or unwind the fish tape about the center axis, and wherein the winder insert has a peripheral section defining a plurality of concave sprockets to engage mating surfaces at the inner periphery of the reel.

8. The winder insert of claim 7, wherein at least one of the sprockets defines a concave surface sized to abut a convex surface at the inner periphery of the reel.

9. The winder insert of claim 8, wherein there are three sprockets equiangularly spaced about the center axis.

10. The winder insert of claim 7, wherein the winder insert is removably mounted to the reel.

11. The winder insert of claim 7, wherein the winder insert has a flange of a dimension perpendicular to the center axis larger than that of the inner periphery of the reel.

12. The winder insert of claim 11, wherein the reel is disposed between the lever member and the flange.

13. The winder insert of claim 7, wherein a segment of an outer periphery of the winder insert is spaced from a corresponding segment of the inner periphery of the reel.

14. The winder insert of claim 7, wherein the winder insert defines at least one retainer for engaging a surface of the reel.

15. The winder insert of claim 14, wherein the at least one retainer is a spring tab formed integral with and flexible with respect to the winder insert.

16. A manual winder mechanism for a fish tape device having a reel and a reel handle that can be rotated about a center axis relative to the reel handle to wind fish tape around an inner periphery of the reel defining a center opening, the winder mechanism comprising:

a hub having a center opening concentric with the center axis and formed through a sprocket section having an outer periphery adapted to fit within and engage the inner periphery of the reel;

a shaft rotatably disposed within the center opening of the hub along the center axis;

a handle connected to the shaft for rotating the shaft about the center axis; and a clutch disposed along the center axis about the shaft and having an outer surface fixed with respect to the hub, wherein the clutch is rotatable about the center axis by engagement of the shaft when the shaft is rotated in a first rotational direction which thereby rotates the reel in the first rotational direction relative to the reel handle, and wherein the shaft is rotatable in a second rotational direction essentially without rotating the clutch in either the first or second rotational directions.

* * * * *